United States Patent [19]

Braun

[11] 4,085,711

[45] Apr. 25, 1978

[54] FREE PISTON ENGINE WITH OPPOSED CYLINDERS

[76] Inventor: Anton Braun, 6421 Warren Ave., Minneapolis, Minn. 55435

[21] Appl. No.: 612,710

[22] Filed: Sep. 12, 1975

[51] Int. Cl.[2] ..... F02B 71/00; F02B 75/06

[52] U.S. Cl. ..... 123/46 B; 92/75; 123/192 B

[58] Field of Search ..... 123/46 R, 46 B, 192 R, 123/192 B, 56 AC, 56 BC; 60/DIG. 1; 92/69, 75, 130 B, 136

[56] References Cited

U.S. PATENT DOCUMENTS

| | | | |
|---|---|---|---|
| 2,849,888 | 9/1958 | Herbenar | 92/69 R X |
| 3,610,214 | 10/1971 | Braun | 123/46 R |
| 3,661,476 | 5/1972 | Benaroya | 123/46 B |
| 3,722,481 | 3/1973 | Braun | 123/46 R |
| 3,853,100 | 12/1974 | Braun | 123/46 R |
| 3,895,620 | 7/1975 | Foster | 123/46 R |

FOREIGN PATENT DOCUMENTS

| | | | |
|---|---|---|---|
| 2,405,297 | 8/1975 | Germany | 92/136 |

*Primary Examiner*—Charles J. Myhre
*Assistant Examiner*—Craig R. Feinberg

[57] ABSTRACT

A free piston engine having a pair of opposed power cylinders and pistons on a common longitudinal axis with an energy absorbing device, such as a compressor piston, being directly connected to one of the power pistons and indirectly connected to the other power piston by means of a motion reversing, synchronizing and counterbalancing mechanism on said axis. The cylinders are arranged to be fired simultaneously and due to the face that the forces from the power pistons acting on the reversing mechanism are balanced, the forces on the bearings in the mechanism are substantially reduced over those occurring in machines having cylinders that fire 180° out of phase, which results in a minimum of wear and higher efficiency due to the reduced friction. The engine can also have a bounce chamber therein which gives better control and more stable operation of the power pistons than found in engines with alternately acting pairs of power pistons which do not require power piston returning means.

7 Claims, 4 Drawing Figures

FREE PISTON ENGINE WITH OPPOSED CYLINDERS

Free piston engine compressors having axially spaced and alternately firing cylinders are well known in the art, as illustrated in such U.S. Pat. Nos. as Braun 3,610,216, 3,853,100 and Mercier 2,526,384. The engine in each of these patents has synchronizing means which is subject to a maximum force equal to one half of the maximum force from one power piston in one of the cylinders plus one half of the force resulting from the maximum cylinder pressure in the compressor multiplied by the compressor piston's area. In a typical compressor, this results in approximately 16,000 pounds of force from the power piston plus 5,000 pounds of force from the compressor piston for a total of 21,000 lbs load.

Alternately firing engines are also very sensitive to pressure variations in their respective power cylinders. These pressure variations arise in Diesel type engine cylinders due to coking of the nozzles, in spark ignition engines due to differences in carburetor settings, and two cycle engines due to port clogging. Furthermore, alternately acting engines can only vary their output stroke by varying the power cylinder compression ratio, resulting in reduced efficiency at part load operation and possibly not being able to be reduced to zero output.

In my U.S. Pat. No. 3,525,102 there is disclosed an engine having a pair of oppositely moving power pistons in each one of two side by side or parallel cylinders. This design has the disadvantage that should there be a misfiring in one of the cylinders, there would be a twisting of the synchronizing mechanism resulting in a reduction in the efficiency of the engine if not a damaging of the engine. Also, the engine design is so heavy that the speed and the output of the engine would be substantially reduced.

In the present invention, the above mentioned deficiencies in the prior art free piston engine compressors have been eliminated. In contrast, the maximum force on the synchronizing mechanism of this invention, with the same dimensions as the above mentioned prior art example, would be only 10,000 lbs, less than one half of the force on the prior art synchronizer. Furthermore, should there be any misfiring of a cylinder of the present invention, there would be not twisting forces acting on the synchronizing mechanism to adversely affect it. Moreover, the present invention can be fully regulated or controlled between 100 and 0% output without affecting or having to vary the power cylinder compression ratio and, therefore, for all load points, the maximum efficiency.

FIG. 1 of the drawing is a schematic view of one embodiment of the invention,

Figure 1:
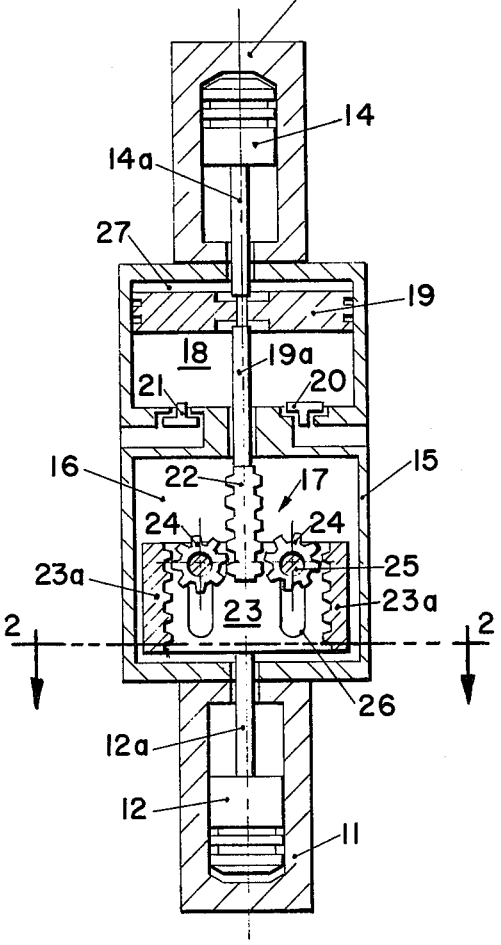

Referring to FIG. 1, the numeral 11 designates a power cylinder having a power piston 12 therein coaxial with and axially spaced from an opposed power cylinder 13 with a power piston 14. Positioned between the two opposed cylinders is a housing 15 having a compartment 16 for a motion reversing, synchronizing and counterbalancing mechanism, generally designated by the numeral 17, and a cylinder 18 with a compressor piston 19 therein. Check valves 20 and 21 permit fluid to enter and leave the cylinder 18, respectively.

The mechanism 17 is generally the same as that shown in detail in my above mentioned U.S. Pat. Nos. 2,610,216 and 3,853,100 so suffice it to say that the mechanism includes a member 22 which is a double rack connected to compressor piston 19 by a piston rod **19*a* and piston 19 is connected to power piston 14 by a piston rod 14*a*. A match-box shaped member 23 has two spaced and inwardly facing gear racks 23*a* and is connected to power piston 12 by piston rods 12*a*. Gears 24 mounted on fixed pinion bearings 25 have teeth that engage the racks on members 22 and 23. Slots 26, through which bearings 25 extend, enable the member 23 to reciprocate in housing 15 in opposite directions to movements of member 22**.

A bounce chamber 27 may have controls (not shown) associated therewith, to aid in the control of the engine's operation, in a conventional manner.

The elements of the invention are illustrated in the positions they normally assume at the time of firing of the fuel in cylinders 11 and 13 during normal operation thereof. Upon firing, piston 12 and member 23 will move toward piston 19 and piston 14, piston 19 and double rack 22 will move towards piston 14. Since the power piston forces are in opposite directions on opposite sides of the gears 24, these forces are balanced with respect to bearings 25. Air or any other fluid being compressed, which has entered cylinder 18 through check valve 20, will be compressed and driven through check valve 21 to the exterior of housing 15. Residual pressure in the compression chamber and/or negative pressure in bounce chamber 19 will then cause the pistons to return to their firing positions.

Figure 3:
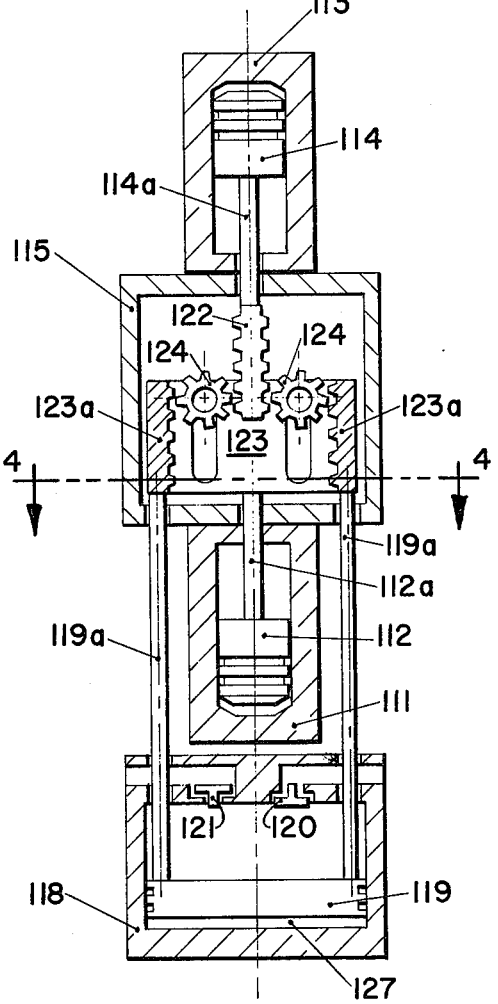
FIG. 3 is a schematic view of a second embodiment of the invention.
Figure 2:
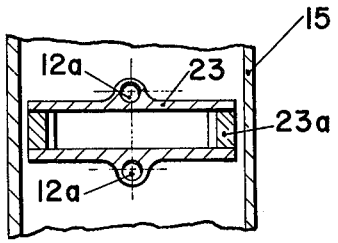
FIG. 2 is a sectional view taken along line 2—2 of FIG. 1.
Figure 4:
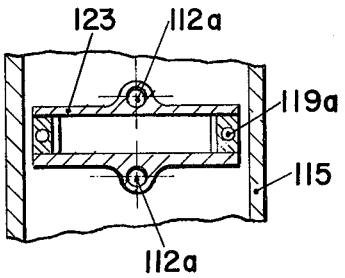
FIG. 4 is a sectional view taken along line 4—4 of FIG. 3.

In the FIG. 3 embodiment of the invention, cylinder 111, with its power piston 112, is located between housing 115 and compressor cylinder 118. Cylinder 113 has its power piston 114 directly connected to a double rack 122 by a rod **114*a* while compressor piston 119 is connected to an outer or spaced rack member 123 by means of two rods 119*a*. Power piston 112 is connected to member 123 by means of rod 112*a***.

The operation of the modification of FIG. 3 is substantially the same as that of FIG. 1, the main difference being that the compressor piston is part of the assembly that includes the spaced rack member 123 rather than the inner double rack 122. This means that the weight of member 123 is much less than the weight of member 23 and that the weight of double rack 122 is much heavier than double rack 22, to provide proper counterbalancing of the oppositely moving assemblies. The weight of other elements of each assembly may also be varied. The functioning of the compressor unit of FIG. 3 is the same as in FIG. 1.

As other modifications of the invention may be made without departing from the spirit of the invention, the scope of the invention is to be determined by the following claims.

I claim:

1. A free piston engine comprising a pair of opposed and axially spaced apart cylinders on a common longitudinal axis, a first power piston in one of said cylinders, a second power piston in the other of said cylinders, an energy absorbing device operably connected to and movable with said first power piston, and motion reversing, synchronizing and counterbalancing means centered on said axis and operably interconnecting said energy absorbing means and said second power piston, said synchronizing and counterbalancing means including a double rack, a pair of spaced gears with one gear each engaging one side each of said double rack and a pair of spaced and rigidly interconnected racks also engaging said gears on opposite sides of said double rack and pair of gears and said cylinders being arranged to fire simultaneously so that each power piston will exert a force in the same direction on said energy absorbing device to cause it to move in one direction.

2. A free piston engine as defined in claim 1 wherein said energy absorbing device is operably connected to the double rack so as to move as a unit therewith.

3. A free piston engine as defined in claim 1 wherein said energy absorbing device is operable connected to said pair of spaced racks so as to move as a unit therewith.

4. The combination of claim 1 wherein said energy absorbing device and said motion reversing, synchronizing and counterbalancing means are positioned between said cylinders.

5. The combination of claim 1 wherein said motion reversing, synchronizing and counterbalancing means is coaxial with and between said cylinders and said energy absorbing device is located beyond one of said cylinders and on the opposite side of the last mentioned cylinder from said motion reversing, synchronizing and counterbalancing means.

6. A free piston engine as defined in claim 1 wherein said energy absorbing device is a compressor.

7. The combination of claim 6 wherein said compressor has a bounce chamber therein.

* * * * *